US010953682B2

(12) United States Patent
Markus

(10) Patent No.: US 10,953,682 B2
(45) Date of Patent: Mar. 23, 2021

(54) LIGHT-STABILIZING TRANSFER MEDIUM

(71) Applicant: KASPAR PAPIR PTE LTD, Singapore (SG)

(72) Inventor: Marko Markus, Zagreb (HR)

(73) Assignee: Kaspar Papir Pte Ltd, Singapore (SG)

( * ) Notice: Subject to any disclaimer, the term of this patent is extended or adjusted under 35 U.S.C. 154(b) by 0 days.

(21) Appl. No.: 16/276,758

(22) Filed: Feb. 15, 2019

(65) Prior Publication Data

US 2020/0171871 A1 Jun. 4, 2020

Related U.S. Application Data

(60) Provisional application No. 62/769,230, filed on Nov. 19, 2018.

(30) Foreign Application Priority Data

Nov. 19, 2018 (EP) ..... 18206893

(51) Int. Cl.
*B41M 5/52* (2006.01)
*B41M 5/39* (2006.01)
*B41M 5/392* (2006.01)

(52) U.S. Cl.
CPC ..... *B41M 5/5227* (2013.01); *B41M 5/39* (2013.01); *B41M 5/392* (2013.01)

(58) Field of Classification Search
CPC ..... B41J 2/01; B41J 2/211; B41J 2/17; B41J 2/17593; B41J 2/2107; B41J 2/1755; B41J 2/2114; B41J 2/2117; B41J 2/2056; B41J 2/21; B41J 2/0057; B41J 3/60; B41J 2002/012; B41J 2/04598; B41J 2/04588; B41J 2/04595; B41J 2/04586; B41J 2/14274; B41J 29/02; B41J 2/17513; B41J 2/17509; B41J 29/13; B41J 2/17533; B41J 2/1606; B41J 2/1642; B41J 2/1609; B41J 2/1433; B41J 2/164; B41J 2/162; B41J 2/161; B41J 2/19; B41M 5/0011; B41M 5/0017; B41M 5/0023; B41M 5/0047; B41M 7/00; B41M 7/0072; B41M 5/52; B41M 5/5218; B41M 5/5227; C09D 11/36; C09D 11/40; C09D 11/30; C09D 11/38; C09D 11/32; C09D 11/322; C09D 11/324; C09D 11/328; C09D 11/101; C09D 11/102; C09D 11/005; C09D 11/54; C09D 11/52; C09D 11/106
See application file for complete search history.

(56) References Cited

U.S. PATENT DOCUMENTS

| | | | | |
|---|---|---|---|---|
| 4,926,190 | A | 5/1990 | Laver | |
| 5,039,598 | A | 8/1991 | Abrramsohn et al. | |
| 5,897,961 | A | 4/1999 | Malhotra et al. | |
| 6,028,028 | A | 2/2000 | Nitta | |
| 6,280,831 | B1 | 8/2001 | Nakanishi et al. | |
| 6,391,154 | B1 | 5/2002 | Nygard et al. | |
| 6,450,633 | B1 | 9/2002 | Kronzer | |
| 6,902,779 | B1 | 6/2005 | de Visser et al. | |
| 7,341,768 | B2 | 3/2008 | de Visser et al. | |
| 7,662,451 | B2 | 2/2010 | de Visser et al. | |
| 2001/0031344 | A1 | 10/2001 | Nordeen et al. | |
| 2002/0098326 | A1 | 7/2002 | Sato et al. | |
| 2002/0170691 | A1 | 11/2002 | Nygard et al. | |
| 2004/0109958 | A1 | 6/2004 | Nigam et al. | |
| 2005/0186363 | A1 | 8/2005 | de Visser et al. | |
| 2006/0073287 | A1* | 4/2006 | Tsutsui | B41M 5/5227 428/32.34 |
| 2006/0169399 | A1 | 8/2006 | Kronzer | |
| 2007/0197738 | A1* | 8/2007 | Ramaraju | C08G 63/181 525/437 |
| 2007/0275217 | A1 | 11/2007 | Saunders et al. | |
| 2008/0008864 | A1 | 1/2008 | Itoh | |
| 2008/0063818 | A1 | 3/2008 | de Visser et al. | |
| 2008/0229962 | A1 | 9/2008 | Shedd et al. | |
| 2009/0104383 | A1 | 4/2009 | Terao et al. | |
| 2012/0160119 | A1 | 6/2012 | Martinovic | |
| 2014/0000706 | A1* | 1/2014 | Mandokoro | C08J 7/0427 136/259 |
| 2014/0045981 | A1* | 2/2014 | Zahalka | C08K 5/17 524/151 |
| 2015/0004425 | A1 | 1/2015 | Zhou | |

FOREIGN PATENT DOCUMENTS

| | | | |
|---|---|---|---|
| CN | 101100580 | A | 1/2008 |
| CN | 101448999 | A | 6/2009 |
| CN | 101537743 | A | 9/2009 |
| DE | 27 10 230 | | 9/1978 |
| EP | 0 350 257 | A1 | 1/1990 |
| EP | 0439363 | A1 | 7/1991 |
| EP | 0 516 505 | | 12/1992 |
| EP | 0555269 | A1 | 10/1993 |

(Continued)

OTHER PUBLICATIONS

Communication cited in European Application No. 19 157 1377 dated May 22, 2019, 10 pages.
European Search Report cited in EP19 15 7337, dated May 15, 2019, 3 pages.
Gantz et al.: "Stable Ultraviolet Light Absorbers", Textile Res. J., vol. 27, No. 3, pp. 244-251 (1957) (Abstract).
International Search report dated Feb. 12, 2014, Extended European search report dated May 10, 2013, European Patent Office; issued for EP appl. No. 12 197 5635 (6 pgs.).
International Search report dated Feb. 12, 2014, European Patent Office issued for PCT appl. No. PCT/EP2013/076767 (4 pgs.).
International Preliminary Report on Patentability dated Jun. 23, 2015,European Patent Office; issued for PCT appl. No. PCT/EP2013/076767 (7 pgs.).

(Continued)

*Primary Examiner* — Manish S Shah
(74) *Attorney, Agent, or Firm* — Rothwell, Figg, Ernst & Manbeck, P.C.

(57) ABSTRACT

The present invention relates to a preparation comprising a light stabilizer, its use for the production of a transfer medium, a process making the same, as well as a transfer medium and its use.

23 Claims, No Drawings

(56) References Cited

FOREIGN PATENT DOCUMENTS

| | | | |
|---|---|---|---|
| EP | 0903246 | A2 | 3/1999 |
| EP | 0903246 | A3 | 10/1999 |
| EP | 1 356 953 | A1 | 10/2003 |
| EP | 1878829 | A1 | 1/2008 |
| EP | 2 014 688 | A1 | 1/2009 |
| EP | 2 236 307 | A | 10/2010 |
| EP | 2402167 | A1 | 1/2012 |
| EP | 2418090 | A2 | 2/2012 |
| EP | 2418090 | A3 | 2/2012 |
| EP | 2743091 | A1 | 6/2014 |
| EP | 12197563 | A1 | 6/2014 |
| EP | 2951025 | A1 | 12/2015 |
| JP | S60 38199 | A | 2/1985 |
| JP | 10-86599 | | 4/1998 |
| JP | 2000501127 | A | 2/2000 |
| JP | 200259693 | A | 2/2002 |
| JP | 2002-521245 | A | 7/2002 |
| JP | 2003-266919 | A | 9/2003 |
| JP | 2003-328282 | A | 11/2003 |
| JP | 2003-336183 | A | 11/2003 |
| JP | 2004-255715 | A | 9/2004 |
| JP | 2004-255717 | | 9/2004 |
| JP | 2005 307 419 | A | 11/2005 |
| JP | 2007-508969 | A | 4/2007 |
| JP | 2007-178669 | A | 7/2007 |
| JP | 1 878 829 | A1 | 1/2008 |
| JP | 2009-291968 | A | 12/2009 |
| JP | 2010 037697 | A | 2/2010 |
| JP | 2010110973 | A | 5/2010 |
| JP | 2012-521909 | A | 9/2012 |
| JP | 5215132 | B2 | 6/2013 |
| WO | 97/18090 | A1 | 5/1997 |
| WO | 0006392 | A1 | 2/2000 |
| WO | 2004/052655 | A1 | 6/2004 |
| WO | 2004052655 | A1 | 6/2004 |
| WO | 2005042262 | A1 | 5/2005 |
| WO | 2007111302 | A1 | 10/2007 |
| WO | 2008006434 | A1 | 1/2008 |
| WO | 2008065395 | A1 | 6/2008 |
| WO | 2010/112507 | A1 | 10/2010 |
| WO | 2011019609 | A1 | 2/2011 |
| WO | 2012/152281 | A1 | 11/2012 |
| WO | 2014095762 | A1 | 6/2014 |

OTHER PUBLICATIONS

Communication of Notices of Opposition cited in EP13821456.4 dated Mar. 26, 2020, 9 pags.

Office Action dated Nov. 10, 2016, European Patent Office; issued for EP appl. No. 13 821 456.4 (6 pgs.).

Picture of air permeance tester, cited in Communication of Notices of Opposition cited in EP13821456.4 dated Mar. 26, 2020.

ISO 5636-1: 1984 (Paper and Board—Determination of air permeance (medium range)—Part 1: General method, 8 pgs.

Internal document regarding correlation of Gurley and Bendtsen porosities Nov. 19, 2019, 1 page.

ISO 5636-5: 2003 (Paper and board—Determination of air permeance and air resistance (medium range)—Part 5: Gurley method), 16 pages.

Extended European Search Report cited in EP12197563.5 dated May 10, 2013, 6 pages.

JIS P 8117: 2009 (Japanese Original) Paper and board-Determination of air permeance and air resistance (medium range)—Gurley method, 19 pages.

Instruction manual Parker Print-Surf (PPS) Porosimeter; published Feb. 2011, 34 pages.

Description of Parker Print Surf Porosimeter, 2 pages, cited in Communication of Notices of Opposition cited in EP13821456.4 dated Mar. 26, 2020.

ISO 5636-3: 1992 (Paper and board—Determination of air permeance (medium range)—Part 3: Bendtsen method), 14 pages.

Description of a typical air permeance test apparatus (L&W Air Permeance) 1 page, cited in Communication of Notices of Opposition cited in EP13821456.4 dated Mar. 26, 2020.

International, Standard, "ISO 5636-3_Paper and board—Determination of air permeance (medium range)—Part3: Bendtsen method" 1, vol. 1, No. 1, Nov. 1, 2013, 8 pages.

International, Standard, "ISO 5636-5 _Paper and board—Determination of air permeance (medium range)—Part 5: Gurley method" 1, vol. 1, No. 1, Nov. 1, 2013, 8 pages.

Japanese Standards, Association, "JIS P 8117:2009 Paper and board—Determination of air permeance and air resistance (medium range)—Gurley method" 1, vol. 1, No. 1, Jul. 1, 2009, 2 pages.

The TMI Group, of Companies, "Parker Print-Surf (Product data sheet)" 1, vol. 1, 22 Mar. 2005, 1 page.

Hawley's Condensed Chemical Dictionary, Nov. 23, 1993, 4 pages, pp. 1034-1035.

* cited by examiner

LIGHT-STABILIZING TRANSFER MEDIUM

CROSS REFERENCE TO RELATED APPLICATION

This application is claims the benefit of U.S. Provisional Application No. 62/769,230 filed on Nov. 19, 2018 and European Patent Application No. 18 206 893.2 filed on Nov. 19, 2018, the disclosures of which are incorporated herein in their entirety by reference.

The present invention relates to a preparation comprising a light stabilizer, its use for the production of a transfer medium, a process making the same, as well as a transfer medium and its use.

Transfer printing denotes the printing of different materials, such as textiles, using transfer media. Transfer media are printed by sublimable dyes which are subsequently transferred onto the materials to be printed via sublimation using a thermal transfer press. Transfer printing is an increasing market due to the enormous variability of materials to be printed at reasonable costs, e.g. in communications (banners, displays, soft signage, fine arts, flags, entertainment, etc.), fashion (caps, costumes, dresses, jackets, scarfs, shirts, etc.), sportswear and other fields.

WO 00/06392 discloses a transfer paper, in particular for inkjet printing, provided at least on the side to be printed, with a release or barrier layer, the layer having a porosity of at most 100 ml/min.

US 2012/0160119 describes a method for producing transfer papers by applying a first aqueous liquid to the front side of a paper, which is to be printed, the first aqueous liquid comprising ammonium polyacrylate. US '119 further suggests including additives into the first aqueous liquid, such as $SiO_2$ or silicate particles, cellulose derivatives, or polyhydric alcohols.

Enormous efforts have been taken in order to balance the combination of paper and coating in order to improve the transfer paper in terms of ink yield, print quality, cost efficiency etc. (EP 2 951 025, EP 2 418 090).

A general problem in printing technology is the degradation of the dyes, but also of the material surface by electromagnetic radiation such as sunlight, in particular UV radiation. UV radiation in the sense of the present invention refers to electromagnetic radiation having a shorter wavelength than visible light, e.g. a wavelength from 10 nm to 400 nm. UV radiation may be classified in near UV (290-400 nm), far UV (180-290 nm) and vacuum UV (below 180 nm). The term UVA is used to represent a wavelength range between 320 and 400 nm, UVB is defined as radiation having a wavelength of between 290-320 nm. UVC represents a range of below 290 nm. Usually, radiation below 290 nm is absorbed by the atmosphere and thus not present in the normal environment. UV radiation is present in sunlight, constituting about 10% of the total light output of the sun and may be synthetically produced e.g. by mercury-vapour lamps.

UV radiation is known to cause chemical reactions, such as degradation of dyes and material surfaces, which is often associated with a bleaching of the dye or a yellowing of the materials. UV degradation is a common problem in products, particularly pigments, dyes ("phototendering") and polymeric materials, exposed to sunlight. Particularly susceptible to UV degradation are polymers, such as polypropylene, polyethylene and polyester polymers. When subjected to radiation, dyes having a functional light absorbing group, such as anthraquinones, quinophtalones, azo/diazo, styryl, oxazine, xantene, methane/azomethine groups may form radicals, which can react with oxygen (photooxidation) causing degradation of the dye and/or the polymer.

There is a plurality of additives, which can be incorporated into the bulk material or applied on the surface of the material (e.g. a polymer) to be protected to minimize or avoid UV degradation. Such light stabilizing additives ("light stabilizers") can be classified due to its function in UV absorbers, quenchers, radical scavengers, secondary anti-oxidants or peroxide decomposers.

UV absorbers absorb UV radiation in competition with chromophores, which are part of a material to be protected (e.g. dye or polymer). The aim is to prevent chromophores from being transferred into an excited state, which may cause formation of radicals. If some molecules are already at an excited state, quenchers may bring the chromophore back to its ground state. The quencher accepts the energy of the chromophore and releases the energy as harmless heat or radiation. Radicals, which may cause degradation, may be rendered harmless by so-called radical scavengers. Hindered Amine Light Stabilizers (HALS) and phenolic derivatives are exemplary radical scavengers. Any resulting peroxide may be decomposed by peroxide decomposers, particularly based on thioethers and phosphites.

Modification of materials with light stabilizers usually requires large amounts of potentially harmful compounds to be incorporated into a bulk or elaborate coating processes using these compounds together with harmful solvents.

The inventors have now found preparations for use in producing transfer media, which allow a sublimation of light-stabilizers from a transfer medium to a material to be light-protected. Such sublimation process provides a solvent-free modification of material surfaces at high throughput, since continuous processes are possible. The process according to the invention particularly allows simultaneous printing of materials with sublimation inks and light-stabilizing modification of the same in a one-step process.

In a first aspect, the present invention relates to a preparation comprising (i) at least a hydrophilic organic polymer,
(ii) optionally at least one filler,
(iii) optionally at least one water-soluble alkaline salt,
(iv) at least one light stabilizer, and
(v) water.

A hydrophilic organic polymer according to the present invention refers to a polymer, having at least one hydrophilic functional group, such as an ionic or ionizable group, preferably at least one of a carboxylic acid, carboxylate, sulfonate, hydroxy, amino and acetate group. In a preferred embodiment, the hydrophilic organic polymer is swellable or soluble in water. In a preferred embodiment, the hydrophilic organic polymer particularly has a water-solubility of at least 10 g/l, preferably at least 20 g/l, more preferably at least 50 g/l at 20° C. in distilled water.

Preferably, the hydrophilic organic polymer is selected from the group consisting of polyacrylic acid, polyacrylester, polyacrylamide, polyvinyl alcohol, a copolymer comprising at least one of an acrylic acid, acrylic acid ester, acrylamide and vinyl acetate, or salts thereof, preferably polyacrylic acid or a salt thereof (polyacrylate).

Preferably, polyacrylate is used as a hydrophilic organic polymer. Salts of the hydrophilic organic polymer may comprise as counter ion alkaline cation, such as potassium or sodium cations, or ammonium cations.

The hydrophilic organic polymer may have a weight average molecular weight of 500 g/mol or more, for example 600-50,000 g/mol, more preferably 600-25,000 g/mol.

Polyacrylate in the sense of the present invention means a salt of polyacrylic acid, the carboxylic acid groups of which are at least partially present in the form of a carboxylate salt. In the preferred embodiment, the polyacrylate is selected from the group consisting of alkali polyacrylate, such as sodium or potassium polyacrylate, or ammonium polyacrylate. In a preferred embodiment, the polyacrylate is sodium polyacrylate, potassium polyacrylate or ammonium polyacrylate, most preferably sodium polyacrylate.

The preparation preferably comprises from 1-50 wt.-%, preferably 2-20 wt.-% and even more preferably 4-12 wt.-% of at least one hydrophilic organic polymer based on the total mass of the preparation.

In a preferred embodiment, the preparation may further comprise at least one filler, preferably an inorganic filler, more preferably an inorganic oxide, such as $SiO_2$ or $TiO_2$. The filler is preferably in a nano- or microparticulate form. In a preferred embodiment, the filler used in the preparation is in the form of a colloidal solution, wherein the mean average diameter of the solid particles may be in the range of 1 nm-1 μm, preferably 1 nm-800 nm, more preferably 20 nm-100 nm. The filler may have a specific surface area of 10 to 1,000 $m^2/g$, preferably 45 to 750 $m^2/g$, determined according to ISO 9277.

In a preferred embodiment, the filler is present in the preparation in an amount of 0.2-10 wt.-%, preferably 1-5 wt.-% based on the total mass of the preparation.

In a preferred embodiment, the preparation may further comprise at least one water-soluble alkaline salt. Water-solubility is defined as indicated above. Preferably, the salt is an alkaline salt having a pH value of >7, more preferably >9 at 20° C. in a saturated aqueous solution.

The salt may be selected from (hydrogen)carbonate, $M_2O \times nSiO_2$ with M=alkali metal, aluminate ($[Al(OH)_4]^-$), a phosphate or mixtures thereof. In a preferred embodiment, the water-soluble alkaline salt is water glass or sodium aluminate.

Preferably, the preparation comprises at least one alkali silicate. The at least one water-soluble alkaline salt is preferably present from 0.2-10 wt.-%, preferably 1-5 wt.-% based on the total mass of the preparation.

As indicated above, light stabilizers are known in the art. Light stabilizers typically deactivate high-energy states or absorb energy by transforming the excess energy into harmless light or heat radiation. Alternatively, high-energy molecules, such as radicals, can be converted with radical scavengers that deactivate the active radical by forming a stable (low energetic) radical.

Light stabilizers are typically functionally classified in UV absorbers, light quenchers, radical scavengers, secondary antioxidants and peroxide decomposers. Preferred light stabilizers are UV absorbers, light quenchers, radical scavengers, secondary antioxidants and peroxide decomposers, more preferably UV absorbers, light quenchers, and radical scavengers, even more preferably UV absorbers and radical scavengers.

In a preferred embodiment, the light stabilizer sublimates at a temperature of 140-220° C., preferably 160-220° C. Preferably, the light stabilizers have a sublimation enthalpy of $\Delta_{SUB}H$ of 20 to 150 kJ/mol at 298 K.

Typically the light stabilizer does not contain any ionic groups, such as carboxylic or sulfonic groups, that is the light stabilizer is non-ionic. Preferably, the light stabilizer is water-insoluble or at least partially water-insoluble. Water insolubility in the sense of the present invention refers to a compound that has a water solubility of less than 5 g/l, preferably less than 3 g/l in distilled water at 20° C.

As described above, the UV absorber dissipates the absorbed energy as thermal energy or light, which does not affect the material to be protected. Preferably the UV absorber absorbs radiation in the range of between 290-400 nm. The upper limit of 400 nm should not be exceeded due to undesirable color formation. Preferably, the UV absorber is based on benzophenone, benzotriazole, oxalanilide, phenyltriazine and derivatives thereof.

More preferably, the UV absorber is selected from (2-hydroxyphenyl)benzotriazole (BTZ), hydroxyphenyl-s-triazine (HPT), 2-hydroxybenzophenone (BP), oxalanilide, Benzotriazole-1 (2-(2-hydroxy-3-tert-butyl-5-propionicacidisooctylester)-2H-benzotriazole), Benzotriazole-2 (2-(2-hydroxy-3,5-di-tert-amylphenyl)-2H-benzotriazole), Benzotriazole-3 (reaction product of 2-(2-hydroxy-3-tert-butyl-5-propionic acid methyl ester)-2H-benzotriazole and polyethylene glycol 300), Benzotriazole-4 (2-[2-hydroxy-3,5-di(1,1-dimethylbenzyl)phenyl]-2H-benzo-triazole), HPT-1 (2-{4-[(2-hydroxy-3-dodecyloxy/tridecyloxypropyl)oxy-2-hydroxyphenyl]}-4,6-bis(2,4-dimethylphenyl)-1,3,5-triazine), HPT-2 (2-[4-(2-hydroxy-3-(2-ethylhexyl)oxy-2-hydroxyphenyl)]-4,6-bis(2,4-dimethylphenyl)-1,3,5-triazine), HPT-3 (2-(4-octyloxy-2-hydroxyphenyl)-4,6-bis(2,4-dimethylphenyl)-1,3,5-triazine), Benzophenone-1 (2-hydroxy-4-octyloxybenzophenone), Benzophenone-2 (2-hydroxy-4-dodecyloxybenzophenone), and Oxalanilide-1 (N-(2-ethoxyphenyl)-N'-(4-isododecylphenyl)ethanediamide).

The radical scavenger is preferably selected from phenols, its derivatives and Hindered Amine Light Stabilizers (HALS), particularly based on piperidine and its derivatives, more particularly based on 2,2,6,6-tetramethyl-piperidine and its derivatives.

Preferred Hindered Amine Light Stabilizers are selected from HALS-1 (bis(2,2,6,6-tetramethyl-4-piperidinyl)sebacate), HALS-2 (bis(1,2,2,6,6-pentamethyl-4-piperidinyl)sebacate), HALS-3 (bis(1-octyloxy-2,2,6,6-tetramethyl-4-piperidinyl)sebacate), HALS-4 (bis(1,2,2,6,6-pentamethyl-4-piperidinyl)[3,5-bis(1,1-dimethylethyl-4-hydroxyphenyl) methyl]butylpropandioate), HALS-5 (N-(1,2,2,6,6-pentamethyl-4-piperidinyl)-2-dodecsyulccinimide), HALS-6 (N-(1-acetyl-2,2,6,6-tetramethyl-4-piperidinyl)-2-dodecylsuccinimide), and HALS-7 (N-(2-hydroxyethyl-2,2,6,6-tetramethylpiperidine-4-ol succinic acid copolymer).

The quencher is preferably selected from organic nickel compounds.

The secondary anti-oxidant is preferably based on phosphite or thioether and its derivatives, such as triphenoxyphosphine.

It may be advantages to combine more than one light stabilizer, which may gain much better protection than the single-use. Preferred are combinations of UV absorbers and radical scavengers.

The light stabilizer may be present in an amount of 0.001-5 wt.-%, preferably 0.1-2 wt.-% based on the total mass of the preparation.

The preparation can further comprise at least one polyhydric alcohol, such as glycerol, preferably in an amount of 0.1-1.5 wt.-% based on the total mass of the preparation.

The preparation further comprises water to form an aqueous preparation. The solid content of the preparation (without water) is preferably 15 to 50 wt.-%, more preferably 20 to 30 wt.-% based on the total mass of the preparation.

Typically, the preparations are made by solving components (i) and (iii) in water (v) and suspending components (ii) and (iv) in the thus obtained solution. Components (ii) and (iv) may be suspended by high-shear mixers, if required.

In a preferred embodiment, components (ii) and/or (iv) may be pre-suspended, e.g. in water, before adding it to the solution described above.

In one aspect, the preparation according to the invention is used for the production of a transfer medium. Herein the front side of a base substrate is coated with a preparation according to the present invention.

Consequently, in another aspect, the present invention refers to a process for manufacturing a transfer medium, comprising the steps a) applying the preparation of the invention to the front side of a base substrate and subsequent drying; and
b) optionally applying an aqueous liquid to the reverse side of the base substrate and subsequent drying, the aqueous liquid optionally comprising a hydrophilic polymer or salt thereof.

The base substrate may be paper, plastic or metal, preferably paper. Preferably, the base substrate has a Bendtsen porosity of 0-1,000 ml/min, preferably 0-200 ml/min, more preferably 0-100 ml/min, even more preferably 0-50 ml/min (measured according to Bendtsen Test; DIN 5636-3).

In a preferred embodiment, the preparation (including water) is applied to the base substrate in an amount of 10-40 $g/m^2$, preferably 15-25 $g/m^2$. After drying of the preparation, a coating is obtained, preferably having a dry weight of 0.2-25 $g/m^2$, more preferably 2.5-8 $g/m^2$. The coating layer preferably has a porosity of greater than 100 ml/min. The porosity of the coating layer may be measured according to ISO standard 5636-3 on a high-porosity base substrate (e.g. high-porosity base paper) having a porosity of at least 700 ml/min. If the base substrate of the transfer medium has a lower porosity, the porosity of the dry coating layer may be determined by reproducing the process for manufacturing a transfer medium according to the invention, except that a highly porous base substrate having a porosity of at least 700 ml/min (instead of the base substrate of the invention) is used. The value obtained by the Bendtsen Test corresponds approximately to the porosity of the coating layer, assuming that the porosity of the base substrate can be neglected.

In a preferred embodiment, the aqueous liquid to be applied to the reverse side of the base substrate comprises a hydrophilic polymer, such as polyacrylate, starch, cellulose or derivatives thereof. Preferably, the aqueous liquid is applied to the reverse side of the base substrate in an amount of 10-40 $g/m^2$, preferably 15-25 $g/m^2$. After drying of the aqueous liquid, a coating is obtained, preferably having a dry weight of 0.2-25 $g/m^2$, more preferably 0.2-5 $g/m^2$.

The preparation and/or the aqueous liquid can be applied to the base substrate by conventional methods, for example using a doctor blade, a roller coater, by spraying or by curtain coating. After the application, the base substrate is usually dried at room temperature or at an elevated temperature, for example at 40-120° C., more preferably at 80-120° C.

The process above may further comprise step c), wherein a pattern is printed on the front side with at least one sublimable ink, preferably by inkjet printing.

Thus, in a further aspect, the present invention refers to a transfer medium obtainable by the above-described process.

It has been shown that the transfer medium (coated with the preparation according to the invention) ideally receives the ink without smearing and at high drying velocity. Moreover, it has been found that the sublimable dyes are located on the upper surface of the transfer medium, thus, providing optimum transfer yields during the transfer process (see below).

A further aspect of the present invention is the use of the transfer medium of the invention which may be optionally printed for modifying articles. In a preferred embodiment, the article is textile, stoneware, porcelain, more preferably the article is a textile, e.g. a textile fabric, particularly comprising polyester, polyethylene, polypropylene, polyamide, more particularly polyester fibers.

In another aspect, the present invention provides a process for modifying articles, in particular textiles, wherein the article to be modified is brought into contact with the front side of the transfer medium according to the invention at an increased temperature, such that the sublimable components, e.g. light stabilizers and optionally sublimable pigments on the front side of the transfer medium are transferred from the transfer medium to the article.

Usually, the process is conducted at temperatures of 140-240° C. During the transfer process, pressures of e.g. up to 15 bar may be applied. In a preferred embodiment, the process is particularly carried out between rolls exerting said pressure, e.g by means of heat transfer roll press and/or heat transfer flat press. Under these conditions, the sublimable components sublimate and deposit on the article to be modified.

In a preferred embodiment, the surface of the article to be modified allows the sublimable components to be integrated into its surface. It has been found that particularly textile fabrics, more preferably made from polyesters, or polyamides, allow a migration of the sublimable components into its fibers.

The process according to the invention thus provides a one-step procedure in order to modify articles with a light stabilizer. If the transfer medium is suitably printed, the article may be modified not only by light stabilizers, but also by the respective print pattern in a one-step process. This is particularly advantageous since light stabilization of transfer printed articles previously required a two-step process, meaning a first process, wherein the article is modified with light stabilizers, e.g. via surface modification (e.g. via spraying) or via bulk modification (e.g. via compounding), and a second step, wherein the article is printed. According to the invention, the modification and the printing step can be carried out with a single sublimation transfer in an one-step procedure.

The process according to the present invention moreover, can be conducted without any precautionary measures at the modification sites, since no hazardous solvents (for applying the light stabilizers) are required. The process according to the invention can be conducted in a continuous manner, meaning that the modified textile fabrics can be continuously produced by a role-to-role process.

In a further aspect, the present invention relates to a modified article obtainable by a process as described above.

The present invention is illustrated by way of the following example.

EXAMPLE

Preparation 100 g of water, 10 g of aqueous colloidal $SiO_2$ ($SiO_2$ content: 30 wt.-%), 4 g of $Na_2SiO_3$, 1 g of $NaHCO_3$, 40 g of aqueous polyacrylic acid (polyacrylic acid content: 25 wt.-%) and 30 g of water mixed together at room temperature in the respective order to give a clear preparation. Further, 1.85 g Chimassorb 81 (2-Hydroxy-4-(octyloxy) benzophenone are added by an high-speed mixer to give a stable suspension.

Manufacture of the Transfer Medium

The preparation was applied to a base paper having a porosity of 300 ml/min and a grammage of 82 g/m$^2$. The aqueous liquid was applied by using a 6 μm rod and then dried at 100° C. The dry weight of the coating layer was determined to be 3 g/m$^2$.

Multi-color patterns using sublimable dyes (Sawgrass Sublijet HD) were applied to the above produced transfer medium via inkjet printer (Sawgrass SG 400). After 60 seconds, the printed transfer medium was completely dried and was used for the transfer printing process.

The printed transfer medium was contacted with a piece of polyester fabric and was treated at about 200° C. for 45 seconds in a flat press at 4 bar. Following completion of the transfer print, a textile fabric with a mirror inverted inkjet pattern was obtained.

For comparison, the same procedure was followed with a preparation without Chimassorb 81. Both, the example and the comparative example were subjected to xenon arc lamp treatment for 48 hours at a constant temperature of 65° C. and relative humidity of 80%. After exposure, the textile was analysed by a spectrophotometer.

It has been shown that the comparative example has a higher yellow degree than the example modified with Chimossorb. The quality of the print of the Example is excellent, even after irradiation. The print of the comparative Example before irradiation is qualitatively identical to the print of the Example. However, after irradiation with the xenon arc lamp, it has been shown that the green and blue color suffered from a significant yellow tint in the comparative Example. Moreover, the color intensity measured by spectrophotometer of the comparative example was lower than of the example with Chimassorb.

The example also shows that the production of a light stabilized sublimation printed article can be obtained by a process according to the present invention in a one-step procedure.

The invention is further characterized by the following items:

1. Preparation comprising
   (i) at least one hydrophilic organic polymer,
   (ii) optionally at least one filler,
   (iii) optionally at least one water-soluble alkaline salt,
   (iv) at least one light stabilizer, and
   (v) water.
2. Preparation according to claim 1, wherein the preparation has a solid content of 15 to 50 wt.-%, preferably 20 to 30 wt.-% based on the total mass of the preparation.
3. Preparation according to any of claim 1 or 2, wherein the hydrophilic organic polymer is selected from the group consisting of polyacrylic acid, polyacrylester, polyacrylamide, polyvinyl alcohol, a copolymer comprising at least one of an acrylic acid, acrylic acid ester, acrylamide and vinyl acetate or salts thereof, preferably polyacrylic acid or a salt thereof (polyacrylate).
4. Preparation according to any of the preceding claims, wherein the at least one hydrophilic organic polymer is present in an amount of 1-50 wt.-%, preferably 2-20 wt.-% based on the total mass of the preparation.
5. Preparation according to any of the preceding claims, wherein the filler is an inorganic oxide, preferably $SiO_2$ or $TiO_2$, preferably in nanoparticulate or microparticulate form.
6. Preparation according to any of the preceding claims, wherein the preparation comprises from 0.2 to 10 wt.-%, preferably 1-5 wt.-% of filler based on the total mass of the preparation.
7. Preparation according to any of the preceding claims, wherein the alkaline salt is selected from hydrogen (carbonate), $M_2O{\times}nSiO_2$ with M=alkali metal, aluminate or phosphate salt, particularly water glass and sodium aluminate.
8. Preparation according to any of the preceding claims, wherein the alkaline salt is present from 0.2 to 10 wt.-%, preferably 1-5 wt.-%, based on the total mass of the preparation.
9. Preparation according to any of the preceding claims, wherein the light stabilizer is selected from a UV absorber, a light quencher, a radical scavenger, a secondary anti-oxidant and a peroxide decomposer, and is preferably present in an amount of 0.001-5 wt.-%, preferably 0.1-2 wt.-% based on the total mass of the preparation.
10. Preparation according to any of the preceding claims, wherein the light stabilizer sublimates at a temperature in the range of 140-220° C.
11. Preparation according to any of the preceding claims, wherein the light stabilizer is non-ionic and is preferably water-insoluble.
12. Preparation according to any of the preceding claims, wherein the light stabilizer is free of carboxylic or sulfonic groups.
13. Preparation according to any of claims 9-12, wherein the UV absorber dissipates the absorbed irradiation as thermal energy.
14. Preparation according to any of claims 9-13, wherein the UV absorber is based on benzophenone, benzotriazole, oxalanilide, phenyltriazine, and derivatives thereof.
15. Preparation according to claim 14, wherein the UV absorber is selected from (2-hydroxyphenyl)benzotriazole (BTZ), hydroxyphenyl-s-triazine (HPT), 2-hydroxybenzophenone (BP), oxalanilide, Benzotriazole-1 (2-(2-hydroxy-3-tert-butyl-5-propionicacidisooctylester)-2H-benzotriazole), Benzotriazole-2 (2-(2-hydroxy-3,5-di-tert-amylphenyl)-2H-benzotriazole), Benzotriazole-3 (reaction product of 2-(2-hydroxy-3-tert-butyl-5-propionic acid methyl ester)-2H-benzotriazole and polyethylene glycol 300), Benzotriazole-4 (2-[2-hydroxy-3,5-di(1,1-dimethylbenzyl)phenyl]-2H-benzo-triazole), HPT-1 (2-{4-[(2-hydroxy-3-dodecyloxy/tridecyloxypropyl)oxy-2-hydroxyphenyl]}-4,6-bis(2,4-dimethylphenyl)-1,3,5-triazine), HPT-2 (2-[4-(2-hydroxy-3-(2-ethylhexyl)oxy-2-hydroxyphenyl)]-4,6-bis(2,4-dimethylphenyl)-1,3,5-triazine), HPT-3 (2-(4-octyloxy-2-hydroxyphenyl)-4,6-bis(2,4-dimethylphenyl)-1,3,5-triazine), Benzophenone-1 (2-hydroxy-4-octyloxybenzophenone), Benzophenone-2 (2-hydroxy-4-dodecyloxybenzophenone), and Oxalanilide-1 (N-(2-ethoxyphenyl)-N'-(4-isododecylphenyl) ethanediamide).
16. Preparation according to any of claims 9-12, wherein the radical scavenger is selected from phenol and its derivatives and hindered amine light stabilizers (HALS), particularly based on piperidine and its derivatives.
17. Preparation according to claim 16, wherein the hindered amine light stabilizer is selected from HALS-1 (bis(2,2,6,6-tetramethyl-4-piperidinyl)sebacate), HALS-2 (bis(1,2,2,6,6-pentamethyl-4-piperidinyl)sebacate), HALS-3 (bis(1-octyloxy-2,2,6,6-tetramethyl-4-piperidinyl)sebacate), HALS-4 (bis(1,2,2,6,6-pentamethyl-4-piperidinyl)[3,5-bis(1,1-dimethylethyl-4-hydroxyphenyl)methyl] butylpropandioate), HALS-5 (N-(1,2,2,6,6-pentamethyl-4-piperidinyl)-2-dodecsyulccinimide), HALS-6 (N-(1-acetyl-2,2,6,6-tetramethyl-4-piperidinyl)-2-dodecylsuccinimide), and HALS-7 (N-(2-hydroxyethyl-2,2,6,6-tetramethylpiperidine-4-ol succinic acid copolymer).

18. Preparation according to any of the preceding claims, wherein the quencher is selected from organic nickel compounds.

19. Preparation according to any of the preceding claims, wherein the secondary anti-oxidant is based on phosphite or thioether, such as triphenoxyphosphin.

20. Preparation according to any of the preceding claims, further comprising at least one polyhydric alcohol such as glycerol, preferably in an amount of 0.1 to 1.5 wt.-% based on the total mass of the preparation.

21. Use of a preparation according to any of claims 1-20 for the production of a transfer medium, wherein the front side of a base substrate is coated with such preparation.

22. A process for manufacturing a transfer medium comprising the steps (a) applying a preparation according to any of claims 1-20 to the front side of a base substrate, and subsequent drying; and (b) optionally applying an aqueous liquid to the reverse side of the base substrate and subsequent drying, the aqueous liquid optionally comprising a hydrophilic polymer or a salt thereof.

23. The process according to claim 22, wherein the base substrate is selected from the group consisting of paper, plastic and metal.

24. The process according to any of claim 22 or 23, wherein the aqueous liquid comprises a hydrophilic polymer such as polyacrylate, starch, cellulose or derivatives thereof.

25. The process according to any of claims 22-24, wherein the preparation and optionally the aqueous liquid is each applied to the base substrate in an amount of 10-40 g/m$^2$, preferably 15-25 g/m$^2$.

26. The process according to any of claims 22-25, wherein after drying of the preparation a coating having a dry weight of 0.2 to 25 g/m$^2$, preferably 2.5 to 8 g/m$^2$, is obtained on the front side of the base medium.

27. The process according to any of claims 22-26, wherein after drying of the preparation a coating layer having a porosity of >100 ml/min is obtained on the front side of the base medium.

28. The process according to any of claims 22-27, which further comprises step (c) printing a pattern on the front side with at least one sublimable ink, preferably by inkjet printing.

29. Transfer medium obtainable by the process according to any of claims 22-28.

30. Use of a transfer medium, which is optionally printed, according claim 29 for modifying articles, in particular textiles.

31. Use according to claim 30, wherein the article is a textile fabric, particularly comprising polyester fibers.

32. Process for modifying articles, in particular textiles, wherein the article to be modified is brought into contact with the front side of the transfer medium according to claim 29 at increased temperature, such that the sublimable components on the front side are transferred from the transfer medium to the article.

33. Modified article obtainable by a process according to claim 32.

The invention claimed is:

1. An aqueous preparation comprising (i) at least one hydrophilic organic polymer, (ii) optionally at least one filler, (iii) optionally at least one water-soluble alkaline salt, (iv) at least one light stabilizer, and (v) water, wherein said aqueous preparation has a solid content of 15-50%, and wherein the light stabilizer is free of carboxylic and sulfonic groups.

2. The aqueous preparation according to claim 1, wherein the hydrophilic organic polymer is selected from the group consisting of polyacrylic acid, polyacrylester, polyacrylamide, polyvinyl alcohol, a copolymer comprising at least one of an acrylic acid, acrylic acid ester, acrylamide and vinyl acetate or salts thereof.

3. The aqueous preparation according to claim 1, wherein the filler is an inorganic oxide.

4. The aqueous preparation according to claim 1, wherein the alkaline salt is selected from the group consisting of hydrogen (carbonate), M2O×nSiO2 with M=alkali metal, aluminate and phosphate salt.

5. The aqueous preparation according to claim 1, wherein the light stabilizer is selected from a UV absorber, a light quencher, a radical scavenger, a secondary anti-oxidant and a peroxide decomposer.

6. The aqueous preparation according to claim 1, wherein the light stabilizer sublimates at a temperature in the range of 140-220° C.

7. The aqueous preparation according to claim 1, wherein the light stabilizer is non-ionic and is at least partially water-insoluble.

8. The aqueous preparation according to claim 5, wherein the UV absorber dissipates the absorbed irradiation as thermal energy.

9. The aqueous preparation according to claim 5, wherein the UV absorber is based on benzophenone, benzotriazole, oxalanilide, phenyltriazine, and derivatives thereof.

10. The aqueous preparation according to claim 1, wherein the UV absorber is selected from the group consisting of (2-hydroxyphenyl)benzotriazole (BTZ), hydroxyphenyl-s-triazine (HPT), 2-hydroxybenzophenone (BP), oxalanilide, Benzotriazole-1 (2-(2-hydroxy-3-tert-butyl-5-propionicacidisooctylester)-2H-benzotriazole), Benzotriazole-2 (2-(2-hydroxy-3,5-di-tert-amylphenyl)-2H-benzotriazole), Benzotriazole-3 (reaction product of 2-(2-hydroxy-3-tert-butyl-5-propionic acid methyl ester)-2H-benzotriazole and polyethylene glycol 300), Benzotriazole-4 (2-[2-hydroxy-3,5-di(1,1-dimethylbenzyl)phenyl]-2H-benzo-triazole), HPT-1 (2-{4-[(2-hydroxy-3-dodecyloxy/tridecyloxypropyl)oxy-2-hydroxyphenyl]}-4,6-bis(2,4-dimethylphenyl)-1,3,5-triazine), HPT-2 (2-[4-(2-hydroxy-3-(2-ethylhexyl)oxy-2-hydroxyphenyl)]-4,6-bis(2,4-dimethylphenyl)-1,3,5-triazine), HPT-3 (2-(4-octyloxy-2-hydroxyphenyl)-4,6-bis(2,4-dimethylphenyl)-1,3,5-triazine), Benzophenone-1 (2-hydroxy-4-octyloxybenzophenone), Benzophenone-2 (2-hydroxy-4-dodecyloxybenzophenone), and Oxalanilide-1 (N-(2-ethoxyphenyl)-N'-(4-isododecylphenyl)ethanediamide).

11. The aqueous preparation according to claim 5, wherein the radical scavenger is selected from phenol and its derivatives and hindered amine light stabilizers (HALS).

12. The aqueous preparation according to claim 11, wherein the hindered amine light stabilizer is selected from the group consisting of HALS-1 (bis(2,2,6,6-tetramethyl-4-piperidinyl)sebacate), HALS-2 (bis(1,2,2,6,6-pentamethyl-4-piperidinyl)sebacate), HALS-3 (bis(1-octyloxy-2,2,6,6-tetramethyl-4-piperidinyl)sebacate), HALS-4 (bis(1,2,2,6,6-pentamethyl-4-piperidinyl)[3,5-bis(1,1-dimethylethyl-4-hydroxyphenyl)methyl]butyl¬propan¬dioate), HALS-5 (N-(1,2,2,6,6-pentamethyl-4-piperidinyl)-2-dodecsyulccinimide), HALS-6 (N-(1-acetyl-2,2,6,6-tetramethyl-4-piperidinyl)-2-dodecylsuccinimide), and HALS-7 (N-(2-hydroxyethyl-2,2,6,6-tetramethylpiperidine-4-ol succinic acid copolymer).

13. The aqueous preparation according to claim 1, wherein the quencher is selected from organic nickel compounds.

14. The aqueous preparation according to claim 1, wherein the secondary anti-oxidant is based on phosphite, such as triphenoxyphosphin.

15. The aqueous preparation according to claim 1, further comprising at least one polyhydric alcohol in an amount of 0.1 to 1.5 wt.-% based on the total mass of the preparation.

16. A process for manufacturing a transfer medium comprising the steps (a) applying an aqueous preparation according to claim 1 to the front side of a base substrate, and subsequent drying; and (b) optionally applying an aqueous liquid to the reverse side of the base substrate and subsequent drying, the aqueous liquid optionally comprising a hydrophilic polymer or a salt thereof.

17. The process according to claim 16, wherein the aqueous liquid comprises a hydrophilic polymer selected from the group consisting of such as polyacrylate, starch, cellulose and derivatives thereof.

18. The process according to claim 16, wherein after drying of the preparation a coating layer having a porosity of >100 ml/min is obtained on the front side of the base substrate.

19. The process according to claim 16, further comprising (c) printing a pattern on the front side with at least one sublimable ink.

20. Transfer medium obtainable by the process according to claim 16.

21. A method for modifying an article which is optionally printed, comprising contacting an article to be modified with a transfer medium according claim 20 at an increased temperature such that the light stabilizer and any other sublimable components are transferred from the transfer medium to the article, wherein said article is a textile comprising polyester fibers.

22. Process for modifying articles, in particular textiles, wherein the article to be modified is brought into contact with the front side of the transfer medium according to claim 20 at increased temperature, such that the sublimable components on the front side are transferred from the transfer medium to the article.

23. Modified article obtainable by a process according to claim 22.

* * * * *